United States Patent [19]

Varlonga

[11] 4,130,972

[45] Dec. 26, 1978

[54] PANEL FOR SOUNDPROOF AND FIREPROOF INNER WALLS

[76] Inventor: Giovanni Varlonga, Piazza della Repubblica, 7, Milano, Italy

[21] Appl. No.: 806,223

[22] Filed: Jun. 13, 1977

[30] Foreign Application Priority Data

Jun. 25, 1976 [IT] Italy ..... 24756 A/76

[51] Int. Cl.[2] ..... E04B 2/58; E04B 1/62

[52] U.S. Cl. ..... 52/241; 52/393; 52/408; 52/471; 52/586; 52/802

[58] Field of Search ..... 52/408, 404, 238, 241, 52/619, 242, 562, 582, 393, 471, 586

[56] References Cited

U.S. PATENT DOCUMENTS

| | | | |
|---|---|---|---|
| 2,736,399 | 2/1956 | Spencer | 52/404 |
| 3,319,738 | 5/1967 | Wehe | 52/404 |
| 3,830,027 | 8/1974 | Paisley | 52/619 |
| 3,990,202 | 11/1972 | Becker | 52/404 |

FOREIGN PATENT DOCUMENTS

| | | | |
|---|---|---|---|
| 920043 | 3/1963 | United Kingdom | 52/404 |

*Primary Examiner*—John E. Murtagh

*Attorney, Agent, or Firm*—Guido Modiano; Albert Josif

[57] ABSTRACT

Panel for soundproof and fireproof inner walls, of a type comprising two parallel reinforcing metal plates mechanically interconnected to form an interspace therebetween and a filler of insulating material, constituted essentially of rock-wool like material arranged in the interspace. At least one continuous diaphragm extends parallel to the reinforcing metal plates and divides the filler into parallel layers. The diaphragm comprises a plate of solid refractory material having projecting edges projecting beyond the filler. The reinforcing metal plates have folded edges constituting section member like portions thereof. The projecting edges are in engagement with the folded edges of the metal plates. The folded edges are seam folded to hold the metal plates together.

7 Claims, 5 Drawing Figures

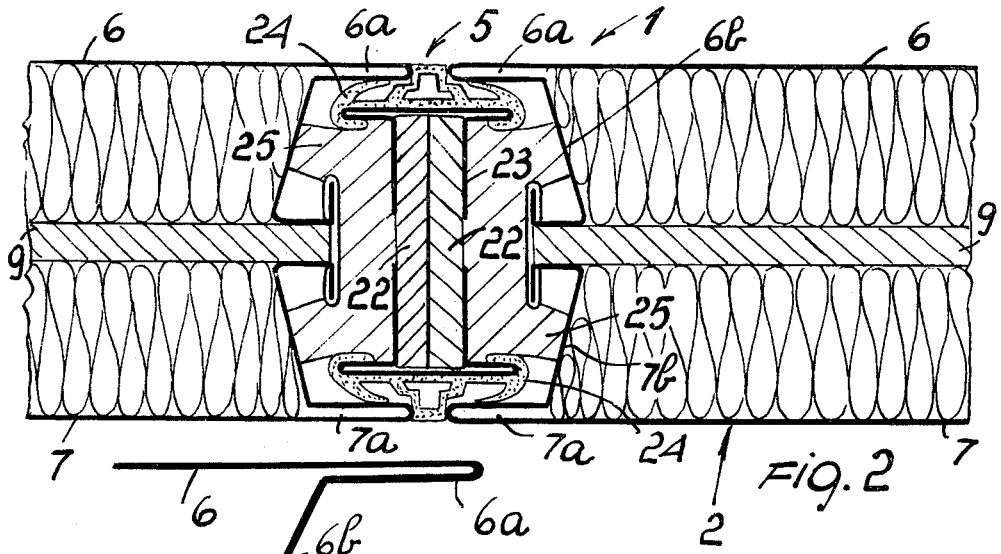
Fig. 2
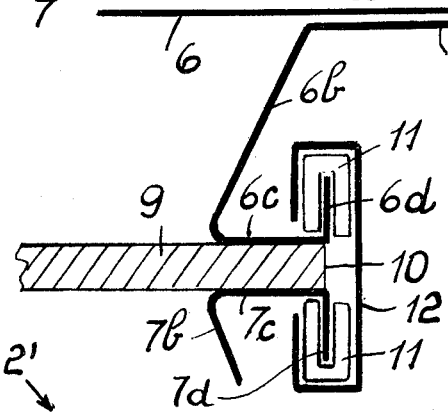
Fig. 3
Fig. 5
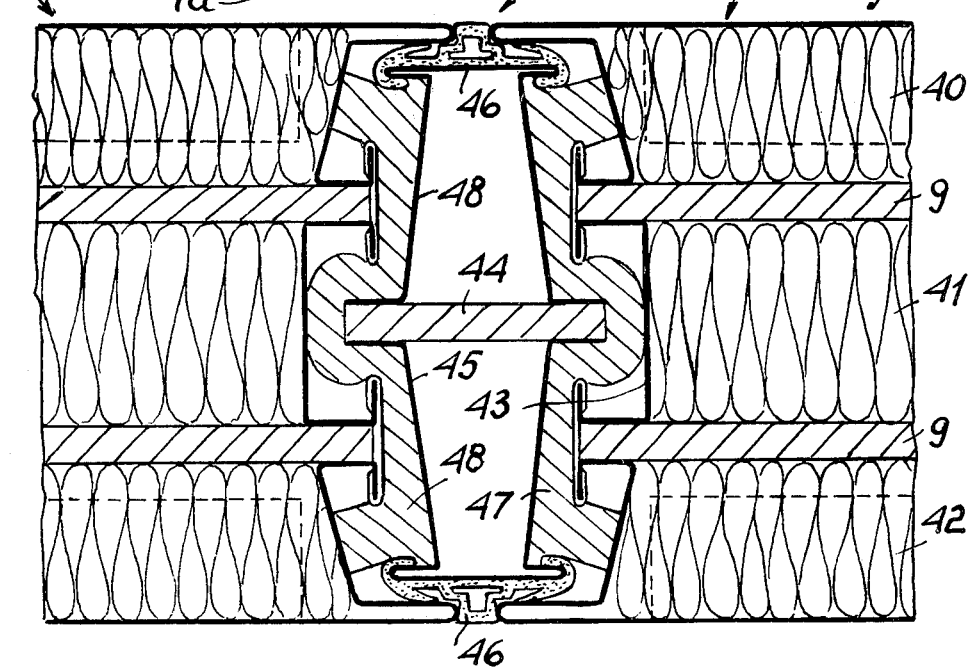

PANEL FOR SOUNDPROOF AND FIREPROOF INNER WALLS

BACKGROUND OF THE INVENTION

This invention relates to multipurpose panels, particularly for use in soundproof and fireproof partition walls.

In modern construction art, soundproof partition walls are a common requirement. However, fire-resisting properties are less sought for in the instance of such walls. This because the traditional building materials are inherently fire-resistant, thereby the serious hazard represented by a wall which is not fireproof is not always perceived.

Quite often it is considered enough that the material employed be non-conductive of heat, which is generally a common property of soundproofing materials, and incombustible. Such requisites fail, however, to provide adequate safety in the event of a conflagration because the organic materials, as currently employed in today's constructional projects, while affording good thermal and acoustical insulation and being incombustible, do decompose with heat absorption at high temperatures, thus losing their mechanical as well as insulating properties; in general, they carbonize and/or evolve into gases, depending on whether oxygen is present or not. And yet, the function of a fire-resisting wall is not restricted to being fireproof but rather extended to include the formation of a barrier against flame propagation. To this end, it is not enough that the wall be just capable of withstanding high temperatures, but it also must not transmit heat, not even at open flame temperatures. Thus, and contrary to a widespread notion, shared even by some experts, a steel wall or door has very poor fire arresting capabilities, far less than a wooden one. The old wall of bricks or concrete were excellent from the viewpoint of their ability to withstand fire, but they are not sound absorbent and do not lend themselves very well to the modern techniques of prefabrication and erection of walls and panels. Heretofore, it may be said that there has been made available no panel designed in accordance with modern building wall prefabrication practice, in particular for use in partition or inner walls, that fulfils all of the requisites set forth above at one time.

SUMMARY OF THE INVENTION

Accordingly, this invention is mainly directed to filling the above mentioned gap in the prior art building prefabrication art.

More specifically, it is a primary object of this invention to provide a panel, specially for inner or partition walls, which is at one time soundproof and fireproof.

It is another object of the invention to provide such a panel which is reinforced with steel plates that enclose it and form an integral unit therewith, the two plates being thermally insulated from each other.

It is a further object of the invention to provide a panel structure as above, which is easily adaptable for predetermined ratings of resistance to fire.

Still another object is to provide a soundproof and fireproof wall made up with such panels.

These and other objects, such as will be apparent hereinafter, are achieved by a panel for soundproof and fireproof inner walls, of a type comprising two parallel reinforcing metal plates mechanically interconnected to form an interspace therebetween and a filler of insulating material, constituted essentially of rock-wool like material in said interspace characterized in that it comprises at least one continuous diaphragm extending parallel to said reinforcing metal plates and deviding said filler into parallel layers, said diaphragm comprising a plate of solid refractory material and having projecting edges projecting from said filler, said reinforcing metal plates having folded edges constituting section member like portions thereof, said projecting edges being in engagement with said folded edges of said metal plates, said folded edges being seam folded to hold said metal plates together.

BRIEF DESCRIPTION OF THE DRAWINGS

The invention features and advantages will be more clearly understood from the following detailed description of practical embodiments thereof, being preferred but not restrictive ones, which will be described hereinbelow by way of example only, with reference to the accompanying drawing, where:

FIG. 2 is a section taken through the line II—II of FIG. 1;

FIG. 3 is an enlarged detail view of FIG. 3;

FIG. 5 is a detail view of FIG. 2, in accordance with another embodiment of the invention.

DESCRIPTION OF THE PREFERRED EMBODIMENTS

Figure 1:
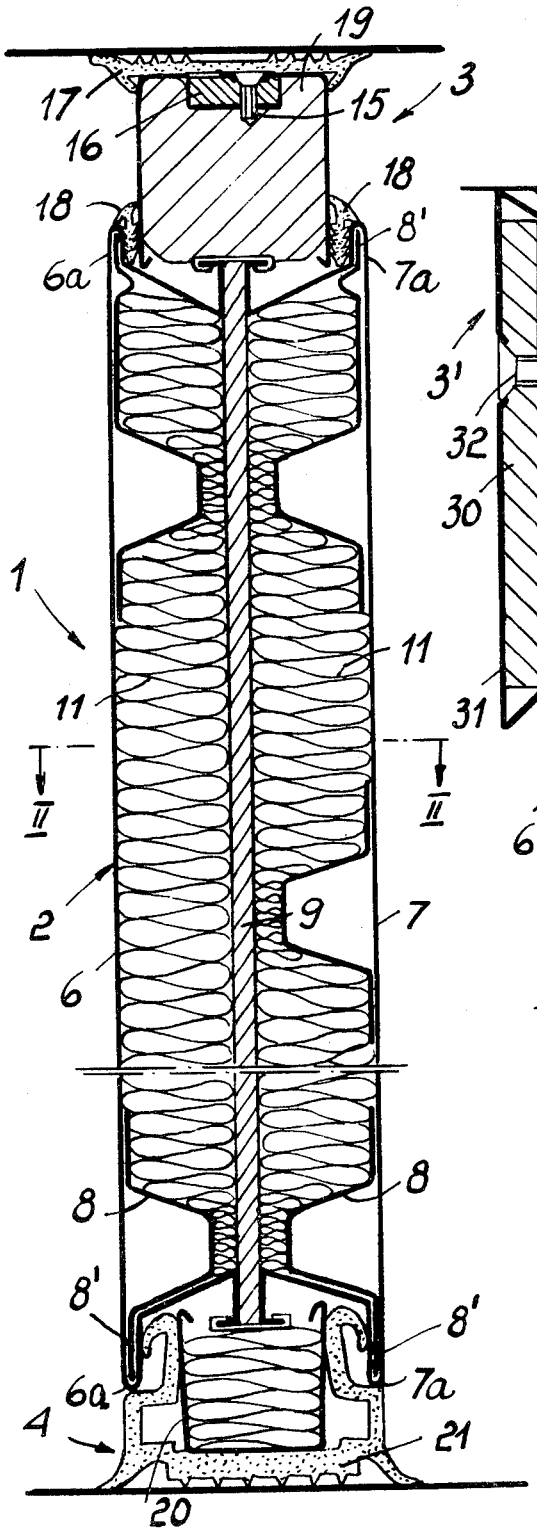
FIG. 1 is a vertical cross-sectional view of a panel according to this invention, shown as installed.

Making reference first to FIGS. 1 and 2, the numeral 1 denotes generally a wall formed with panels 2. As is common practice in the installation of panels to form a wall, a single panel is mounted in the height direction of the wall, and plural panels are laid side by side in the length direction of the wall, with gaps or interruptions known per se, for doorposts or other inserts. The panels are held aligned and close together at the ceiling and floor by upper stringers 3 and lower stringers 4, between two abreast panels there intervening a vertical joint 5. In addition to the panel 2, this invention also provides for the stringers 3, 4 and joint 5, as accessory items which are integral parts of the instant panel; these will be explained in that order, as will be explained their arrangements and their mode of cooperation.

A panel 2 comprises two metal plates or sheets 6 and 7 forming the outer faces thereof and thus the panel enclosing walls, such plates being preferably zinc galvanized. The plates 6 and 7 are flat along their entire surfaces, being only folded or bent at the edges, as will be explained hereinafter. In the interspace left between the two plates, and adherent to the plates, there are located horizontal ribs or stiffening crossmembers 8, also of zinc galvanized metal plate or sheet, only thinner, at arbitrary distances and positions, and either on one face or both, either facing one another or intermingled, at the designer's discretion; these may also be left out entirely, their function being merely a mechanical one, thus foreign to this invention. At the centerplane of the panel, a refractoy plate 9 is positioned, preferably of the asbesto-cement known in the trade as "Eternit", said plate being 6 mm thick and dividing the interspace into two equal parts which are filled with two layers of rock wool 10 and 11, thermally insulated from each other. The edges 6*a* and 7*a* of the plates 6 and 7, both at the upper and lower ends, are folded onto the ends 8' of the plate forming the nearest rib 8 or an equivalent cross-member to retain the rock wool contained therein. The edge fold seam of the plates 6 and 7 at the panel edges is effective to anchor the plates to each other without establishing, however, a thermal contact therebetween.

As may be seen best in FIG. 3, each plate 6, 7 is folded over itself to form a side edge *6a, 7a,* respectively, then the plate is folded to form a transverse portion or cross barrier *6b, 7b* and a second portion which bears or abuts as a resilient bracket for a length *6c, 7c* against the edge of the plate 9, to terminate in a wing or flange *6d, 7d* transverse thereto, i.e. which is brought back externally, level with the edge or rim 10 of the plate 9. In order to unite the two ends *6d* and *7d* of the plates without involving any thermal contact at the wings or flanges *6d* and *7d,* small ceramic insulators 111, for high temperatures and having a U-like shape , e.g. of calcium oxide or aluminium oxide, are set astride, a C-like clamp 12 of thermal steel being inserted on the wings with in the insulators to anchor them tensively. Preferably, rather than a continuous clamping strip, several clamps are provided spaced apart in order to reduce heat transmission between the plates. As may be observed, that same fastening of the plates 6 and 7 is effected along the horizontal and vertical edges.

The upper stringer 3 is also formed from two metal plates or sheets, 13 and 14, which create together a U-like section, being united along the bridging portion of the "U" by screws 15 with the interposition of an asbesto-cement strip 16. The bridge of the "U" of the stringer 3 is arranged to face the ceiling, whereon it bears with the interposition of a refractory seal or gasket 17, e.g. made of Dutral. The section side wings or expansions, i.e. of the plates 13, 14, are inserted to act as guides between the upper horizontal edges of the panel, being spaced apart and centered with respect to said edges by refractory insulating strips 18, made of a material similar to that of the gasket 17 and having the purpose the preventing the heat from one panel wall from being transmitted to to the ceiling and vice versa. The upper stringer 3 is filled with a pad of soft asbesto 19, or of an equivalent material. The lower stringer 4 is also formed, as a bearing structure, by a "U" section 20, but is of one piece construction and entirely wrapped externally in a refractory gasket 21, similar to the gaskets 17 and 18, and performing itself both functions thereof, i.e. that of insulating the stringer from the floor and edges *6a, 7a* of the panel, and of centering the same with respect thereto. The section 20 is filled with either rock wool, or soft asbesto, or the like.

Two abreast panels are held aligned and in place by the opposite stringers 3 and 4, wherein they are inserted guide or runway fashion. However, in order to prevent a flame from leaking through the junction line of the two panels, or high temperature heat from propagating to expand fire, a vertical joint or coupling member 5 is interposed between two contiguous panels, said joint being a force fit, or slight pressure fit, between the edge pairs *6a* and *7a* of the two panels. The joint 5 (FIG. 2) includes as its web or core two paired strips 22, of asbesto-cement, which are cut from a plate similar to the plate 9 and united together by two brackets 23 or by $\pi$ -like sections which are inserted on their edges, the strips being positioned with the plane containing them perpendicular to the panel plane. Onto the edges and roof of the $\pi$ -like sections, there are inserted, one on each side, two gaskets 24 of a refractory material, which define with their projections a jointing section which serves to retain in a symmetrical position with respect to the strips 22 two projecting sections 25 of soft asbesto, which occupy most of the space between the two contiguous panels by engaging their projections or extensions with cross barriers *6b, 7b* retaining the insulating material respectively, of each panel, thus intercepting any flame leakage path. In discussing the structure of a panel wall, it has been mentioned how the latter is installed, while pointing out elements of likeness and difference from similar prior art walls.

For an explanation of how the added fireproof function is performed, the meaning assigned herein to the term "fireproof function" must be given first. The specifications and tests of a fireproof wall or door, require that these, when exposed with one face to a flame at the typical temperature of a fire, can withstand it, before the opposite face reaches virtually the same temperature level, for a specified time which is of 30–60 minutes for Class F30, and longer than 60 minutes for Class F60. The instant structure conforms to this practice. The rock wool mass has a very high insulating power, not only because it is a refractory material, but also, and better, on account of air trapped in the bundles. If temperature rises to the point of melting rock wool, or softening or sintering it, then the insulating power decreases considerably, both where air pockets are formed which transmit heat by convection, and where clots of molten or softened insulating material are formed, which transmit by conduction; thus, upon rock wool softening or melting, hot wall spots also occur on the other panel face, which may trigger flames in the adjacent room.

The presence, at the middle portion of the panel, of an asbesto-concrete plate or board has the function of preventing the insurgence of such transmission areas through deterioration of the insulating material. The plate or board has a thermal conductivity which is higher than rock wool, but also a higher melting point, thereby even if the first layer of wool, i.e. the one toward the flame, melts or loses insulating power, the plate will protect the second layer for a sufficiently long time, even with strong flames. The advantage of placing the central plate or board rather than, for example, against the walls resides in that the intervening layer, albeit deteriorated, does protect the plate enough to preserve its properties, for at least a long time interval, whereas if in contact with the wall which is directly exposed to flame it could also deteriorate rapidly.

Figure 4:
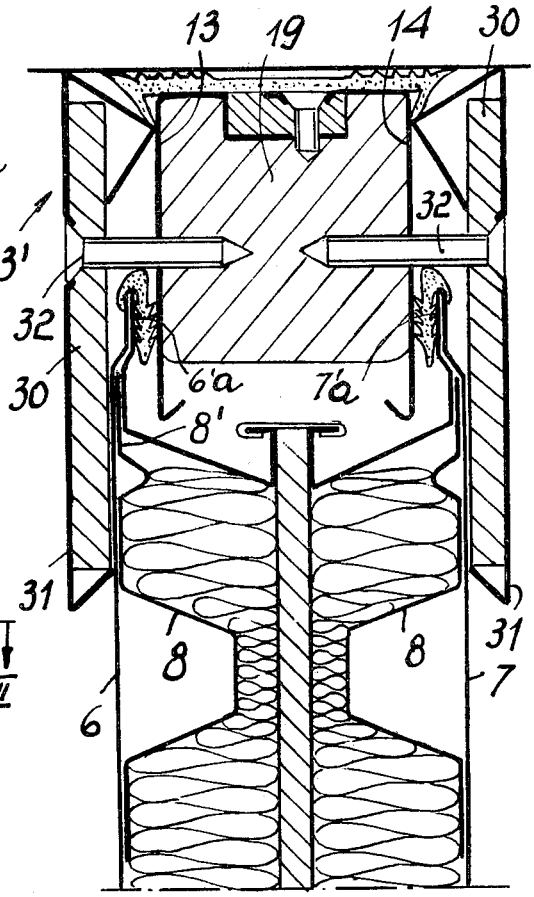
FIG. 4 shows a variation of a FIG. 1 detail.

A similar behavior in fire has been achieved for the stringers and joints. FIG. 4 illustrates a variation, indicated at 3', of the upper stringer 3, which variation similarly applies to the lower stringer 4. This consists of the application at the cited stringer 3, which remains the same per se, of an asbesto-cement strip 30, on each face, having a slightly greater height than the stringer. The strip 30 is covered externally by a zinc galvanized metal plate or sheet 31, and is fastened with screws 32 to the metal plates 13, or respectively 14, of the stringer. Its function is that of increasing the thermal insulation and resistance to fire of the stringer 3, by avoiding a direct exposure thereof to flame. The edges *6'a* and *7'a* are also modified.

FIG. 5 shows another embodiment of the invention intended to provide a wall with higher class fire resisting properties. To obtain a higher resistance to fire, the panels 2' of FIG. 5 have greater thickness, there intervening between such panels two plates or boards 9, parallel to each other and spaced apart from each other, which are identical to the single one shown in FIGS. 1 and 2. Thus three layers 40, 41, and 42, of rock wool or equivalent insulating material, become defined. Between the edges of the two plates 9 intervenes a metal sheet bracket 43 effective to keep them apart and join together, through the clamps 12 and bracket 43, the two wall plates 6 and 7. For their remaining portion, the panels 2' are constructed like the panel 2 and provided for installation with similar stringers, not shown. FIG. 5 also shows a variation of the preferred joint 45 for such panels, which may also be adapted in smaller sizes to the panels 2. The joint 45 comprises a strip 44 of asbesto-cement, located at the centerline and parallel to the planes containing the panels 2'. Two W-like opposite sections 48 rest with their bases thereon, two outwardly extending gaskets 46 being adapted to said sections. For the engagement between the joint and panels there are provided W-like sections of soft asbesto 47 which are part of the joint and ensure a tight seal. This joint utilizes for insulation the effect of small air chambers interposed between the insulating materials, which are effective on account of their small size.

It should be noted that, by way of example, a panel 2 with the proposed materials and a thickness of 60 mm falls within the fireproof class F30, while a panel 2' having a thickness of 100 mm is in class F60.

Without departing from the instant inventive concept, which is that of a sandwich panel including outer plates, layers of rock wool or equivalent thereof, and a middle plate or board of asbesto-cement or equivalent thereof, the embodiment described hereinabove may be varied or modified. Thus for example, instead of a zinc galvanized metal plate a calorized (aluminized) plate may be used at the expense of a slightly higher cost, but with the advantage of an increased resistance to oxidation of the plate at high temperature. As mentioned already, the panels, stringers, and joints may be differently combined together in the various embodiments proposed. The panels also lend themselves to use for partly glazed walls, movable partitions, and other applications.

I claim:

1. A panel for soundproof and fireproof inner walls, of a type comprising two parallel reinforcing metal plates mechanically interconnected to form an interspace therebetween and a filler of insulating material, constituted essentially of rock-wool like material in said interspace characterized in that it comprises at least one continuous diaphragm extending parallel to said reinforcing metal plates arranged in an intermediate position and dividing said filler into parallel layers, said diaphragm comprising a plate of solid refractory material and having projecting edges projecting from said filler and having a rim, said reinforcing metal plates having folded edges constituting section member like portions thereof, said projecting edges being in engagement with said folded edges of said metal plates, said folded edges having each a first portion thereof extending transverse to said diaphragm and said metal plates and a second portion extending from said first portion and arranged parallel and in abutting relationship to said projecting edge of said diaphragm and a flange portion extending from said second portion transverse to said projecting edge of said diaphragm and arranged substantially flush with said rim, an insulator member covering said flange portion and a clamp member connecting said flange portions on both sides of said projecting edge of said diaphragm through said insulator member thereby to avoid thermal contact between said folded edges on one side of said diaphragm and said folded edges on the other side of said diaphragm member.

2. A panel according to claim 1, wherein said refractory plate is of asbesto-cement and is arranged in the centerplane between the two reinforcing metal plates.

3. A panel according to claim 1, wherein in said interspace, there are located two of said refractory plates, being spaced apart from each other and from the reinforcing plates, to the edges whereof are seam folded said folded metal plates together with a sectional plate acting as spacer between the two plates.

4. A panel according to claim 1, wherein in order to stiffen the reinforcing plates, horizontal crossmembers are provided and attached to the metal plates toward the interspace and formed by strips of metal plates bent to section.

5. An inner soundproof and fireproof partition wall constructed with panels according to claim 1, wherein said panels are mounted both at floor and ceiling to upper and lower guiding stringers consisting of a substantially U-like sheet metal section with insulating refractory gaskets for insulating the stringer from the floor, or respectively from the ceiling, and insulating the edges of the section of the stringer from the parallel edges of a panel while concurrently centering said panel, the inside of the section being filled with rock wool or soft asbesto.

6. A wall according to claim 5, wherein in order to increase the resistance to fire the upper and/or lower stringers are covered on two sides by strips of asbesto-cement provided with an outer sheet metal casing.

7. A wall according to claim 5, wherein between adjacent panels is provided a vertical fireproof joint having a rigid core formed by strips of asbesto-cement whereon pads or strips of soft asbesto are made to rest and provide a tight seal against the two contiguous panels, said joint being mainly included between the projecting sheet metal edges of the panel reinforcing metal plates.

* * * * *